US011075030B2

(12) United States Patent
Yoon et al.

(10) Patent No.: US 11,075,030 B2
(45) Date of Patent: Jul. 27, 2021

(54) INDUCTOR ARRAY

(71) Applicant: SAMSUNG ELECTRO-MECHANICS CO., LTD., Suwon-si (KR)

(72) Inventors: Chan Yoon, Suwon-si (KR); Dong Hwan Lee, Suwon-si (KR); Young Ghyu Ahn, Suwon-si (KR); Won Chul Sim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 301 days.

(21) Appl. No.: 16/109,257

(22) Filed: Aug. 22, 2018

(65) Prior Publication Data

US 2019/0259525 A1 Aug. 22, 2019

(30) Foreign Application Priority Data

Feb. 22, 2018 (KR) ..... 10-2018-0021050

(51) Int. Cl.
*H01F 27/24* (2006.01)
*H01F 27/28* (2006.01)
(Continued)

(52) U.S. Cl.
CPC ..... *H01F 27/2823* (2013.01); *H01F 17/04* (2013.01); *H01F 27/24* (2013.01);
(Continued)

(58) Field of Classification Search
CPC ..... H01F 3/08; H01F 27/2823; H01F 27/24; H01F 27/29; H01F 27/292;
(Continued)

(56) References Cited

U.S. PATENT DOCUMENTS

2002/0021201 A1* 2/2002 Oi ..... H01F 17/045 336/197
2007/0063803 A1* 3/2007 Yamashita ..... H01F 17/045 336/83
(Continued)

FOREIGN PATENT DOCUMENTS

JP 2007-067268 A 3/2007
KR 10-2008-0102993 A 11/2008
(Continued)

*Primary Examiner* — Mang Tin Bik Lian
(74) *Attorney, Agent, or Firm* — Morgan, Lewis & Bockius LLP

(57) ABSTRACT

An inductor according to an aspect of the present disclosure is an inductor array comprising a plurality of wire-wound type coils. The inductor array comprises a body comprising a first wire-wound type coil, a second wire-wound type coil, a fixation member, and a sealing material sealing the first wire-wound type coil, the second wire-wound type coil, and the fixation member, and comprising magnetic materials; and external electrodes arranged on an external surface of the body. The fixation member comprises a support portion and a core portion passing through the support portion. The first and second wire-wound type coils are arranged to be spaced apart from each other by the fixation member. The fixation member comprises magnetic materials.

16 Claims, 3 Drawing Sheets

(51) Int. Cl.
*H01F 27/29* (2006.01)
*H01F 27/30* (2006.01)
*H01F 17/04* (2006.01)

(52) U.S. Cl.
CPC ..... *H01F 27/2852* (2013.01); *H01F 27/29* (2013.01); *H01F 27/292* (2013.01); *H01F 27/306* (2013.01); *H01F 2017/048* (2013.01)

(58) Field of Classification Search
CPC .. H01F 27/2852; H01F 27/306; H01F 27/255; H01F 17/04; H01F 17/0006; H01F 17/045; H01F 2017/048; H01F 2017/0073
USPC ..... 336/200, 223, 233
See application file for complete search history.

(56) References Cited

U.S. PATENT DOCUMENTS

2008/0290977 A1 11/2008 Ito et al.
2009/0278652 A1* 11/2009 Shoji ..... H01F 38/08 336/221
2012/0188040 A1* 7/2012 Ogawa ..... H01F 27/027 336/83
2013/0222101 A1* 8/2013 Ito ..... H01F 5/003 336/83
2016/0104564 A1* 4/2016 Jeong ..... H01F 17/06 336/200
2016/0276089 A1* 9/2016 Inoue ..... H01F 41/046
2017/0133150 A1* 5/2017 Lee ..... H01F 41/042
2017/0229232 A1* 8/2017 Takagi ..... H01F 27/306
2017/0345551 A1* 11/2017 Yoshioka ..... H01F 27/2804
2018/0096775 A1* 4/2018 Shibuya ..... H01F 27/2823
2018/0308610 A1* 10/2018 Ishida ..... H01F 17/04
2018/0308630 A1* 10/2018 Shinohara ..... H01F 27/306

FOREIGN PATENT DOCUMENTS

KR 10-2012-0072662 A 7/2012
KR 10-1759963 B1 7/2017

* cited by examiner

INDUCTOR ARRAY

CROSS-REFERENCE TO RELATED APPLICATION

This application claims the benefit of priority to Korean Patent Application No. 10-2018-0021050 filed on Feb. 22, 2018 in the Korean Intellectual Property Office, the disclosure of which may be incorporated herein by reference in its entirety.

TECHNICAL FIELD

The present disclosure relates to an inductor array, and more particularly to an inductor array comprising wire-wound type coils.

BACKGROUND

As smartphones evolve, there is growing demand for thin power inductors having high power, high efficiency, high performance and small size characteristics. Product miniaturization is proceeding from a 2520 (length×width, 2.5 mm×2.0 mm size) product with a thickness of 1.0 mm, common in the past, to a 1608 (length×width, 1.6 mm×0.8 mm size) product with a thickness of 0.8 mm. In order to meet this trend, there is increasing demand for an inductor array that increases efficiency with a reduced mounting area.

Such an array may have a specific form, such as a non-coupled inductor, a coupled inductor, or a combination thereof, depending on a coupling coefficient or mutual inductance between a plurality of coil portions.

In the meantime, leakage inductance in the coupled inductor may be related to output current ripple, and the mutual inductance may be related to inductor current ripple. In order to allow the coupled inductor to have the same output current ripple as a conventional non-coupled inductor, leakage inductance of the coupled inductor should be equal to inductance of the conventional non-coupled inductor. When the mutual inductance increases, the coupling coefficient k may increase, thereby reducing inductor current ripple.

Therefore, if a coupled inductor can reduce inductor current ripple while having the same output current ripple as the conventional non-coupled inductor, as well as having the same size as the conventional non-coupled inductor, efficiency may be increased without increasing the mounting area.

Therefore, in order to increase the efficiency of the inductor array chip while maintaining a size of the chip, it is necessary to provide a coupled inductor having a high coupling coefficient by increasing mutual inductance. In addition, in order to increase a coupling coefficient in the coupled inductor, a gap between coils should be reduced. However, there are limitations to a process of reducing the gap (e.g., aligning the coils that are coupled and precisely controlling the gap between the coils). Therefore, there is a need for a method for increasing a coupling coefficient between coils while overcoming the limitations of the above process.

SUMMARY

An aspect of the present disclosure is to provide an inductor array capable of easily controlling a coupling coefficient by readily adjusting a distance between a plurality of coils spaced from each other.

According to an aspect of the present disclosure, an inductor array includes a body having a first wire-wound type coil, a second wire-wound type coil, a fixation member, and a sealing material, having magnetic materials, sealing the first wire-wound type coil, the second wire-wound type coil, and the fixation member; and external electrodes arranged on an external surface of the body. The fixation member comprises a support portion and a core portion passing through the support portion. The first and second wire-wound type coils are spaced apart from each other by the fixation member in a stacking direction. The fixation member comprises magnetic materials.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
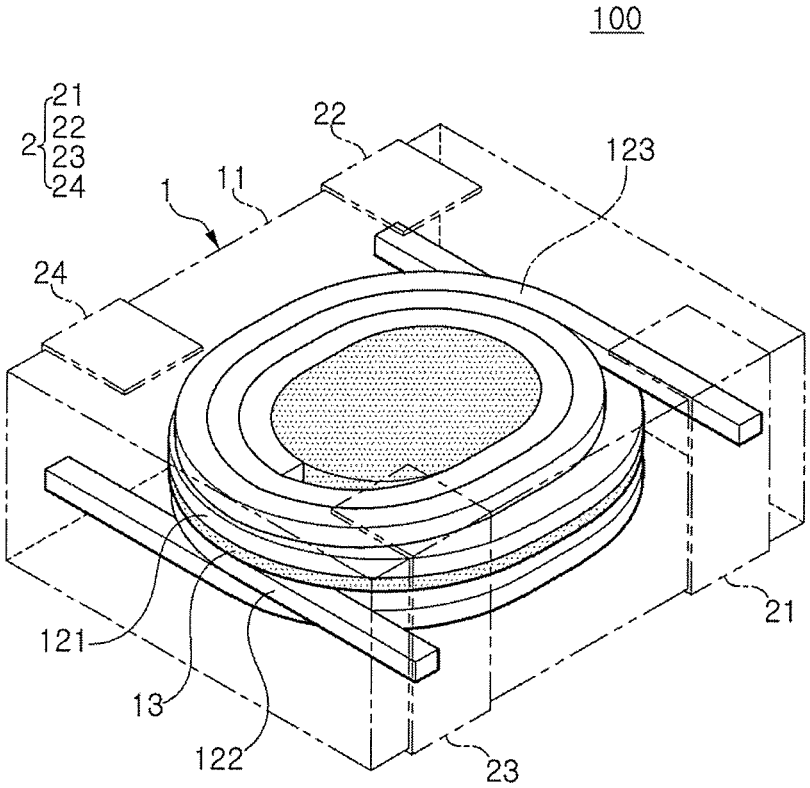
FIG. 1 is a schematic perspective view of an inductor array in accordance with an exemplary embodiment in the present disclosure.

Hereinafter, embodiments of the present disclosure will be described with reference to specific embodiments and the accompanying drawings. However, the embodiments of the present disclosure may be modified into various other forms, and the scope of the present disclosure is not limited to the embodiments described below. Furthermore, embodiments of the present disclosure are provided to more fully describe the disclosure to those skilled in the art. Therefore, the shapes and sizes of the elements in the drawings may be exaggerated for clarity, and elements denoted by the same reference numerals in the drawings are the same elements.

In order to clearly illustrate the present disclosure in the drawings, a portion not related to the illustration will be omitted. Thickness will be enlarged for the purpose of clearly illustrating the layers and regions. Further, the same reference numerals are used to explain the same components having the same functions falling within the scope of the same spirit.

Throughout the specification, when a component may be referred to as "comprise" or "comprising", it means that it may include other components as well, rather than excluding other components, unless specifically stated otherwise.

Hereinafter, an inductor array according to an example of the present disclosure will be described, but the present invention is not limited thereto.

Figure 2:
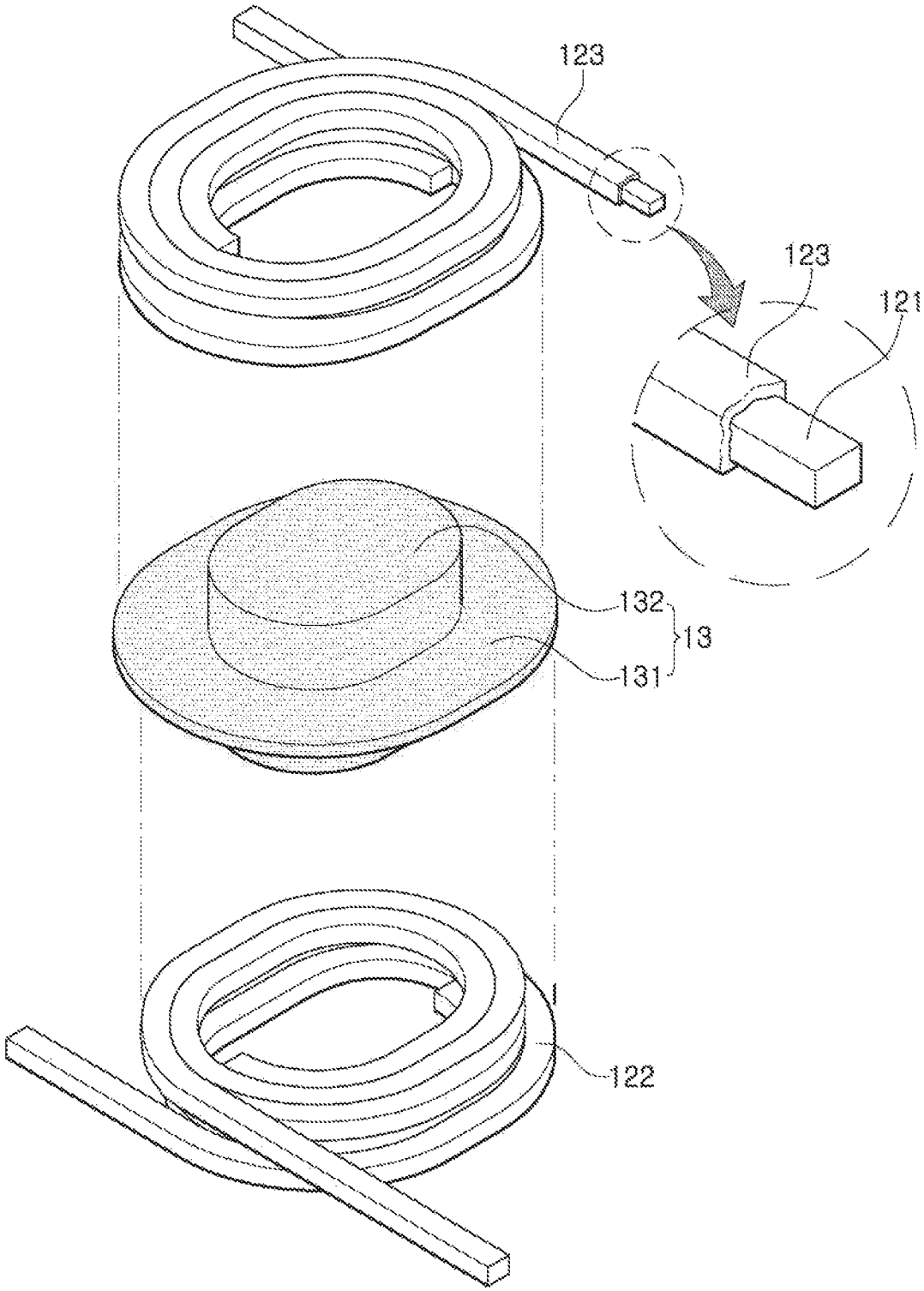
FIG. 2 is a schematic exploded perspective view of a portion of an inductor array of FIG. 1.

FIG. 1 is a schematic perspective view of an inductor array in accordance with an exemplary embodiment in the present disclosure. FIG. 2 is a schematic exploded perspective view of a portion of an inductor array of FIG. 1.

Referring to FIGS. 1 and 2, an inductor array 100 may generally have a chip shape.

The inductor array 100 may include a body 1, and external electrodes 2 arranged on an external surface of the body.

The external electrodes 2 may include a conductive material, and a specific shape thereof may be appropriately selected by those skilled in the art. As shown in FIGS. 1 and 2, the external electrodes 2 may have a "C" shape as a whole, and may be deformed into an "L" shape.

The external electrodes 2 may include first to fourth external electrodes 21, 22, 23 and 24 arranged to be spaced apart from each other. Half of the first to fourth external electrodes 21, 22, 23 and 24 may function as input terminals, and the other half may function as output terminals.

The body 1 may substantially determine the overall appearance of the inductor array 100. The body 1 may be substantially cuboid, which includes an upper surface and a lower surface facing each other in a thickness T direction, a first end surface and a second end surface facing each other in a length L direction, and a first side surface and a second side surface facing each other in a width W direction.

The body 1 may include a sealing material 11. The sealing material 11 may comprise magnetic materials. The magnetic materials may be, for example, ferrite powder or metal powder in a non-limiting manner, as long as the magnetic materials exhibit magnetic properties. The magnetic materials may have a structure dispersed in a resin. The resin may be a thermosetting or thermoplastic resin, for example, an epoxy resin. The sealing material 11 may have a function of sealing components in the body 1 to be described later. Methods of disposing the sealing material are not limited. A method of stacking a plurality of magnetic sheets containing magnetic materials, or a method of filling slurry containing magnetic materials may be utilized.

Components to be sealed by the sealing material 11 may be a first wire-wound type coil 121, a second wire-wound type coil 122, and a fixation member 13.

The first and second wire-wound type coils 121 and 122 may be wire-wound type coils, and there is no limitation on the specific winding method. The first and second wire-wound type coils 121 and 122 may be wound by a circular alpha winding, a flat wire flat-wise alpha winding, a flat wire edge-wise winding, or the like, and may be appropriately selected by those skilled in the art as required.

Surfaces of the first and second wire-wound type coils may be coated with an insulation layer 123. When the insulation layer 123 is not disposed on the surfaces of the first and second wire-wound type coils 121 and 122, there may be a risk of electrical short-circuiting between the magnetic materials in the sealing material 11 and the first and second wire-wound type coils 121 and 122. Therefore, the insulation layer 123 should be uniform and be entirely coated. Materials of the insulation layer 123 may be applied without limitation as long as they exhibit insulating properties.

The first and second wire-wound type coils 121 and 122 may be physically spaced apart from each other. The fixation member 13 may be interposed between the first and second wire-wound type coils 121 and 122 to allow the first and second wire-wound type coils 121 and 122 to be spaced apart from each other. The fixation member 13 may not only function to fix the first and second wire-wound type coils 121 and 122, but also to space the first and second wire-wound type coils 121 and 122 apart from each other at a predetermined interval T.

The fixation member 13 may include magnetic materials, to have magnetic properties. The magnetic materials may be the same materials as the magnetic materials included in the sealing material 11, or may be different materials. Particularly, in order to improve magnetic permeability, powder particles having a high magnetic permeability may be applied as magnetic materials for forming the core portion 132 of the fixation member 13.

The fixation member 13 may include a support portion 131 adjusting a spacing distance T between the first and second wire-wound type coils 121 and 122, and a core portion 132 passing through the support portion. The support portion 131 and the core portion 132 may be separately produced and assembled together. Alternatively, the support portion 131 and the core portion 132 may be integrally formed. An outer boundary line of the support part 131 may be a circular type as a whole, but is not limited thereto. The outer boundary line of the support portion 131 may have a shape corresponding to outer boundary lines of the first and second wire-wound type coils 121 and 122. When the outer boundary line of the support portion 131 is formed in an outer portion relative to the outer boundary lines of the first and second wire-wound type coils 121 and 122, the first and second wire-wound type coils 121 and 122 may be more stably supported.

The support portion 131 may be of a plate type. In this case, the term plate type may refer to a shape including an upper surface and a lower surface facing each other and being flat, while having a certain thickness irrespective of an outer boundary line.

In the absence of the support portion 131, the spaced distance between the first and second wire-wound type coils 121 and 122 may be not easy to be adjusted. This is because it may be difficult to maintain the final thickness and uniformity of the slurry, for example, when a slurry containing a magnetic material is filled between the first wire-wound type coil 121 and the second wire-wound type coil 122. In the meantime, the distance between the first and second wire-wound type coils 121 and 122 may be an important factor in determining a coupling coefficient. Therefore, when the coupling coefficient is not adjusted, the coupling coefficient of the inductor array 100 may not be controlled.

Therefore, the coupling coefficient of the inductor array 100 required by the support portion 131 may be carefully controlled.

The core portion 132 passing through the upper and lower surfaces of the support portion 131 may be cylindrical on the whole. The cylinder may have an empty interior space, for example, a hollow shape, but may be filled with magnetic materials having a high magnetic permeability. When the cylinder has the empty interior space, the magnetic materials contained in the sealing material 11 may fill the interior space to improve the magnetic permeability. The core portion 132 may function to stably maintain the first and second wire-wound type coils 121 and 122 in a wound state. In addition, the first and second wire-wound type coils 121 and 122 may be stably wound by the core portion 132. Alignment of the first and second wire-wound type coils 121 and 122 may be accurately controlled. In this case, the control of the alignment may refer to that a core center of the first wire-wound type coil 121 coincides substantially with a core center of the second wire-wound type coil 122.

In the case of the inductor array 100, the coupling coefficient may be easily adjusted while changing the spaced distance between the first and second wire-wound type coils 121 and 122, and the problem of electrical characteristic deterioration caused by the alignment mismatch of the first and second wire-wound type coils 121 and 122 may be not occurred.

Figure 3:
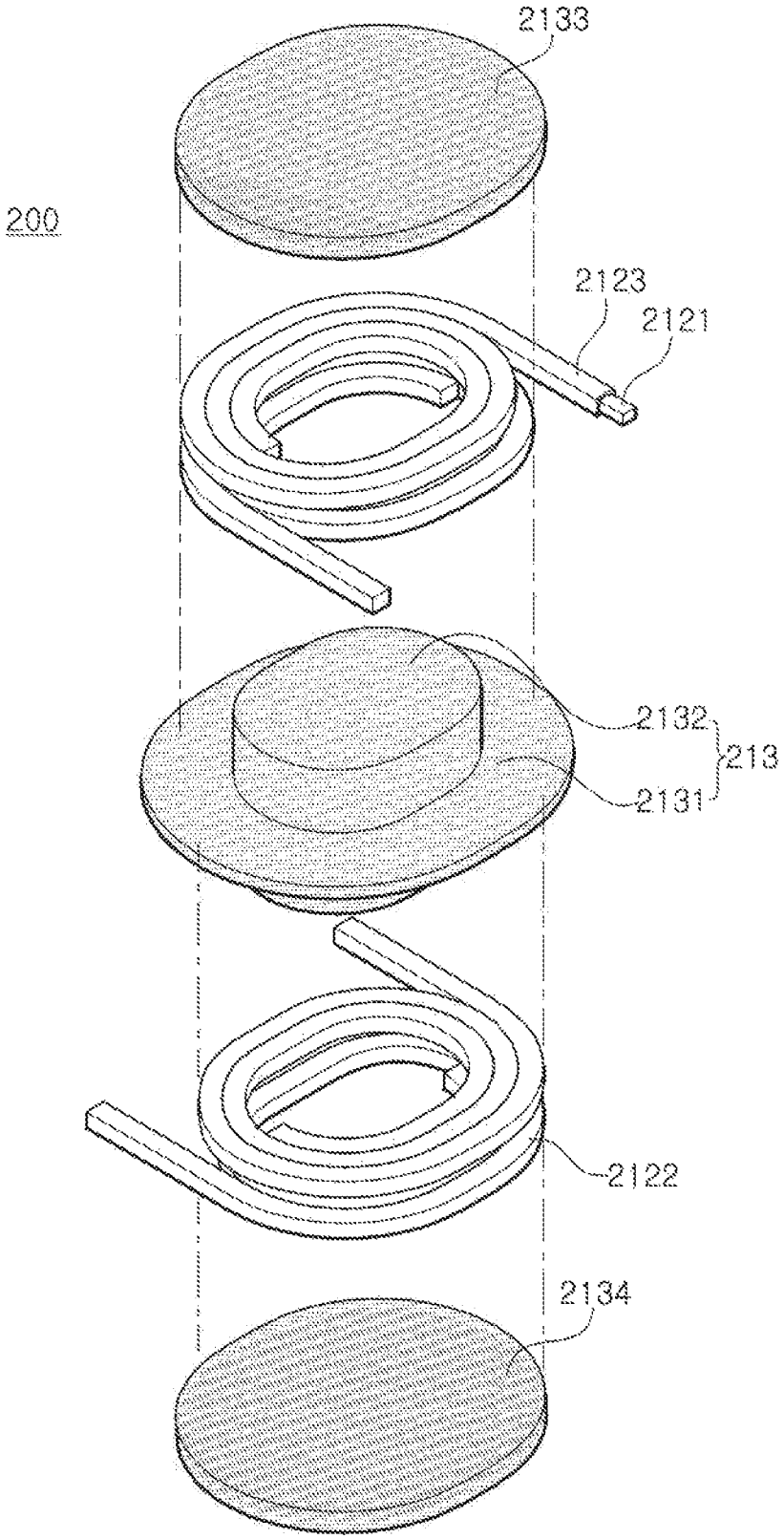
FIG. 3 is a schematic exploded perspective view of a portion of an inductor array for one modified example of an inductor array of FIGS. 1 and 2.

FIG. 3 is a schematic exploded perspective view of a portion of an inductor array 200 for one modified example of the inductor array 100 of FIGS. 1 and 2. Since the inductor array 200 of FIG. 3 differs from the inductor array 100 of FIGS. 1 and 2 in terms of the fixation member, redundant description of the technique is omitted, and the fixation member will be mainly described.

The inductor array 200 of FIG. 3 may include a fixation member 213 inside a body 210. The fixation member 213 may include a support portion 2131 and a core portion 2132. An upper support portion 2133 and a lower support portion 2134 may be further arranged on an upper surface of the fixation member 213.

The upper and lower support portions 2133 and 2134 may also include magnetic materials, similar to those of the fixation member 213. The magnetic materials included in the upper and lower support portions 2133 and 2134 may include magnetic materials that may be the same as the magnetic materials included in the fixation member 213. In this case, the upper and lower support portions 2133 and 2134 and the fixation member 213 may be integrally formed, thereby being efficient in a process.

The upper and lower support portions 2133 and 2134 may have a function of maintaining the first and second wire-wound type coils 2121 and 2122 in a stably wound state, respectively, together with the support portions 2131 interposed between the first and second wire-wound type coils 2121 and 2122. The upper and lower support portions 2133 and 2134 may prevent a risk that may cause displacement of the first and second wire-wound type coils 2121 and 2122, or occur mechanical deformation of the first and second wire-wound type coils 2121 and 2122, as errors in a process due to the applied pressure when the sealing material is filled.

The upper and lower support portions 2133 and 2134 may have a plate shape having a circular outer boundary line. It is preferable in view of process efficiency that the upper and lower support portions 2133 and 2134 and the support portion 2131 are different from each other in thickness only, and have substantially the same shape.

The present disclosure is not limited by the above-described embodiments and the accompanying drawings, but is intended to be limited by the appended claims. Accordingly, various modifications, substitutions, and alterations may be made by those skilled in the art without departing from the spirit of the present disclosure, which may be also fall within the scope of the present disclosure.

In the meantime, the term "exemplary embodiment" used in this disclosure does not mean the same embodiment but is provided for emphasizing and explaining different characteristic features. However, the above-mentioned examples do not exclude that they are implemented in combination with the features of other examples. For example, although the matters described in the specific examples are not described in other examples, they may be understood as descriptions related to other examples, unless otherwise described or contradicted by the other examples.

In the meantime, the terminology used in this disclosure is used only to describe an example, and is not intended to limit the present disclosure. The singular expressions may include plural expressions unless the context clearly dictates otherwise.

While exemplary embodiments have been shown and described above, it will be apparent to those skilled in the art that modifications and variations could be made without departing from the scope of the present invention as defined by the appended claims.

What is claimed is:

1. An inductor array comprising a plurality of wire-wound type coils, comprising:

a body comprising a first wire-wound type coil, a second wire-wound type coil, a fixation member, and a sealing material, having magnetic materials, sealing the first wire-wound type coil, the second wire-wound type coil, and the fixation member, and external electrodes arranged on an external surface of the body, wherein the fixation member comprises a support portion and a core portion passing through the support portion, wherein the first and second wire-wound type coils are spaced apart from each other by the fixation member in a stacking direction, wherein an end portion of the first or second wire-wound type coil extends without being bent, the end portion being defined from an outermost contact point between adjacent coil turns of the first or second wire-wound type coil to a point at which the end portion is connected to one of the external electrodes, wherein at least one of the first and second wire-wound type coils includes upper and lower coils stacked in the stacking direction, and wherein, in a radially-outward direction from a center axis of the first and second wire-wound type coils, a portion of an outermost turn of the lower coil deviates from a portion of an outermost turn of the upper coil adjacent to the portion of the outermost turn of the lower coil.

2. The inductor array according to claim 1, wherein the support portion is plate-shaped.

3. The inductor array according to claim 1, wherein an outer boundary line of the support portion has a shape corresponding to outer boundary lines of the first and second wire-wound type coils.

4. The inductor array according to claim 1, wherein the first wire-wound type coil is wound around the core portion above the support portion, and the second wire-wound type coil is wound around the core portion below the support portion.

5. The inductor array according to claim 1, wherein the external electrodes comprise first and second external electrodes connected to the first wire-wound type coil, and third and fourth external electrodes connected to the second wire-wound type coil.

6. The inductor array according to claim 1, wherein an upper support portion and a lower support portion are further arranged on upper and lower surfaces of the core portion, respectively.

7. The inductor array according to claim 6, wherein the upper support portion and the lower support portion comprise magnetic materials.

8. The inductor array according to claim 7, wherein the magnetic materials included in the upper support portion and the lower support portion are the same type as magnetic materials included in the fixation member.

9. The inductor array according to claim 6, wherein the thicknesses of the upper and lower support portions are different from the thickness of the support portion, with respect to a stacking direction of the plurality of wire-wound type coils.

10. The inductor array according to claim 1, wherein the support portion and the core portion constituting the fixation member are integrally formed.

11. The inductor array according to claim 1, wherein surfaces of the first and second wire-wound type coils are coated with an insulation layer.

12. The inductor array according to claim 1, wherein an outer boundary line of the support portion is positioned in an outer portion relative to outer boundary lines of the first and second wire-wound type coils.

13. The inductor array according to claim 1, wherein the core portion passing through the support portion is formed in a cylindrical shape.

14. The inductor array according to claim 1, wherein the fixation member comprises magnetic materials.

15. The inductor array according to claim 14, wherein the magnetic materials in the fixation member are dispersed in a resin.

16. An inductor array comprising a plurality of wire-wound type coils, comprising:

a body comprising a first wire-wound type coil, a second wire-wound type coil, a fixation member, and a sealing material, having magnetic materials, sealing the first wire-wound type coil, the second wire-wound type coil, and the fixation member, and external electrodes arranged on an external surface of the body, wherein the fixation member comprises a support portion and a core portion passing through the support portion, wherein the support portion and the core portion are integrally formed, wherein the first and second wire-wound type coils are spaced apart from each other by the fixation member in a stacking direction, wherein an end portion of the first or second wire-wound type coil extends without being bent, the end portion being defined from an outermost contact point between adjacent coil turns of the first or second wire-wound type coil to a point at which the end portion is connected to one of the external electrodes, and wherein an upper support portion and a lower support portion are further arranged on upper and lower surfaces of the core portion, respectively.

* * * * *